US005692534A

United States Patent [19]

Brumfield

[11] Patent Number: 5,692,534

[45] Date of Patent: Dec. 2, 1997

[54] PORTABLE OVERHEAD SUN SCREEN

[76] Inventor: James W. Brumfield, 1895 Birch St., Richland, Wash. 99352

[21] Appl. No.: 783,130

[22] Filed: Jan. 14, 1997

[51] Int. Cl.[6] ..... E04H 15/04

[52] U.S. Cl. ..... 135/90; 403/294; 403/353; 482/27; 135/87; 135/117; 135/115; 135/901; 135/123; 135/120.4

[58] Field of Search ..... 135/87, 90, 156, 135/157, 909, 901, 900, 161, 114, 117, 115, 119, 120.1, 120.2, 120.3, 120.4, 123; 403/294, 353; 482/27, 32

[56] References Cited

U.S. PATENT DOCUMENTS

| | | | |
|---|---|---|---|
| 1,573,159 | 2/1926 | Gross . | |
| 2,089,351 | 8/1937 | English . | |
| 2,281,635 | 5/1942 | Strauss . | |
| 2,636,483 | 1/1953 | Service . | |
| 2,928,405 | 3/1960 | Lawson | 135/87 X |
| 2,974,442 | 3/1961 | Womelsdorf . | |
| 3,960,162 | 6/1976 | Noel . | |
| 3,967,026 | 6/1976 | Dalblom . | |
| 4,037,835 | 7/1977 | Forsyth | 482/27 |
| 4,068,404 | 1/1978 | Sheldon . | |
| 4,162,063 | 7/1979 | Nissen et al. | 482/27 |
| 4,285,162 | 8/1981 | Hilton . | |
| 4,644,684 | 2/1987 | Verbeeck . | |
| 4,678,360 | 7/1987 | Miller | 403/353 |
| 4,750,508 | 6/1988 | Tatoian | 135/87 |
| 4,850,084 | 7/1989 | Iwasaki | 403/353 X |
| 5,327,927 | 7/1994 | Oh | 135/115 X |
| 5,415,194 | 5/1995 | Kaye | 135/115 |
| 5,437,298 | 8/1995 | Lin . | |
| 5,553,648 | 9/1996 | Goharsou | 135/900 X |
| 5,622,197 | 4/1997 | Valaire | 135/90 |

*Primary Examiner*—Wynn E. Wood

*Attorney, Agent, or Firm*—Wells, St. John, Roberts, Gregory & Matkin P.S.

[57] ABSTRACT

Portable overhead sun screening structure and canopy are described for shading a surface. The canopy is comprised of at least one sheet spanning a matrix of reinforcing cords that extend to a marginal canopy edge, with beads affixed to the reinforcing cords adjacent the marginal edge. A plurality of elongated poles are spaced apart and set upright along the surface to be shaded. Collars are slidably mounted to the poles for elevational movement thereon. At least two elongated stay members are mounted to each collar, each stay being pivotable between an inoperative position substantially parallel to the associated pole, and an operative position substantially perpendicular to the pole. The stay members on each pole are angularly offset from one another about the associated pole to mount flexible guy cords. Opposed ends of the guy cords are releasable attached to selected stay members about the canopy perimeter. Connector members extend from the flexible guy cords to connect with selected beads on the sheet, to hold the sheet taut over the surface.

19 Claims, 9 Drawing Sheets

PORTABLE OVERHEAD SUN SCREEN

TECHNICAL FIELD

The present invention relates to portable sun shades.

BACKGROUND OF THE INVENTION

In geographical areas where sunlight is intense, shaded surfaces are desirable, if not necessary, for survival of some animals. Poultry, for example, will quickly become dehydrated and die without adequate shade in hot weather. Humans and certain plant life too are adversely effected by too much sun. A need is, therefor, realized for screening devices that will at least partially shield a surface underneath from the sun.

Numerous forms of relatively lightweight portable structures have been produced to shade various size areas. Such structures often take the form of simple umbrellas, awnings, canopies, tents, and similar flexible, portable or permanent shelters. However such structures have limitations, especially when large surface areas are to be covered. The canopy covers typically cannot span large areas due to their flexible nature and the resultant need to place support poles at closely spaced locations not only about the canopy perimeter, but within the area covered by the canopy. The poles restrict movement within the area covered by the canopy and thus eliminate use for certain activities, especially sports.

Another problem associated with large flexible canopies, is that the lightweight and large surface areas render the covers susceptible to damage even in relatively light winds. This problem is addressed by added reinforcement and by the use of additional ground supports. Added reinforcement increases costs and weight, and the additional ground supports restrict the area underneath the covering as indicated above.

The structure described and claimed below overcomes the above problems by providing a canopy that is capable of spanning large surface areas without requiring support from within the area covered by the canopy. Further, the canopy is provided with features that will reduce the problem of wind damage.

BRIEF DESCRIPTION OF THE DRAWINGS

Preferred embodiments of the invention are described below with reference to the following accompanying drawings.

FIG. 9 is an enlarged fragmented plan view showing a portion of a preferred canopy with a pattern of scored flaps;

FIG. 10 is an enlarged fragmented perspective detail showing a pole, collar, stays, and braces on the collars supporting two of the stays in operative positions;

FIG. 13 is a fragmented perspective view of a connector member fastened between the canopy and guy cord.

DETAILED DESCRIPTION OF THE PREFERRED EMBODIMENTS

Figure 1:
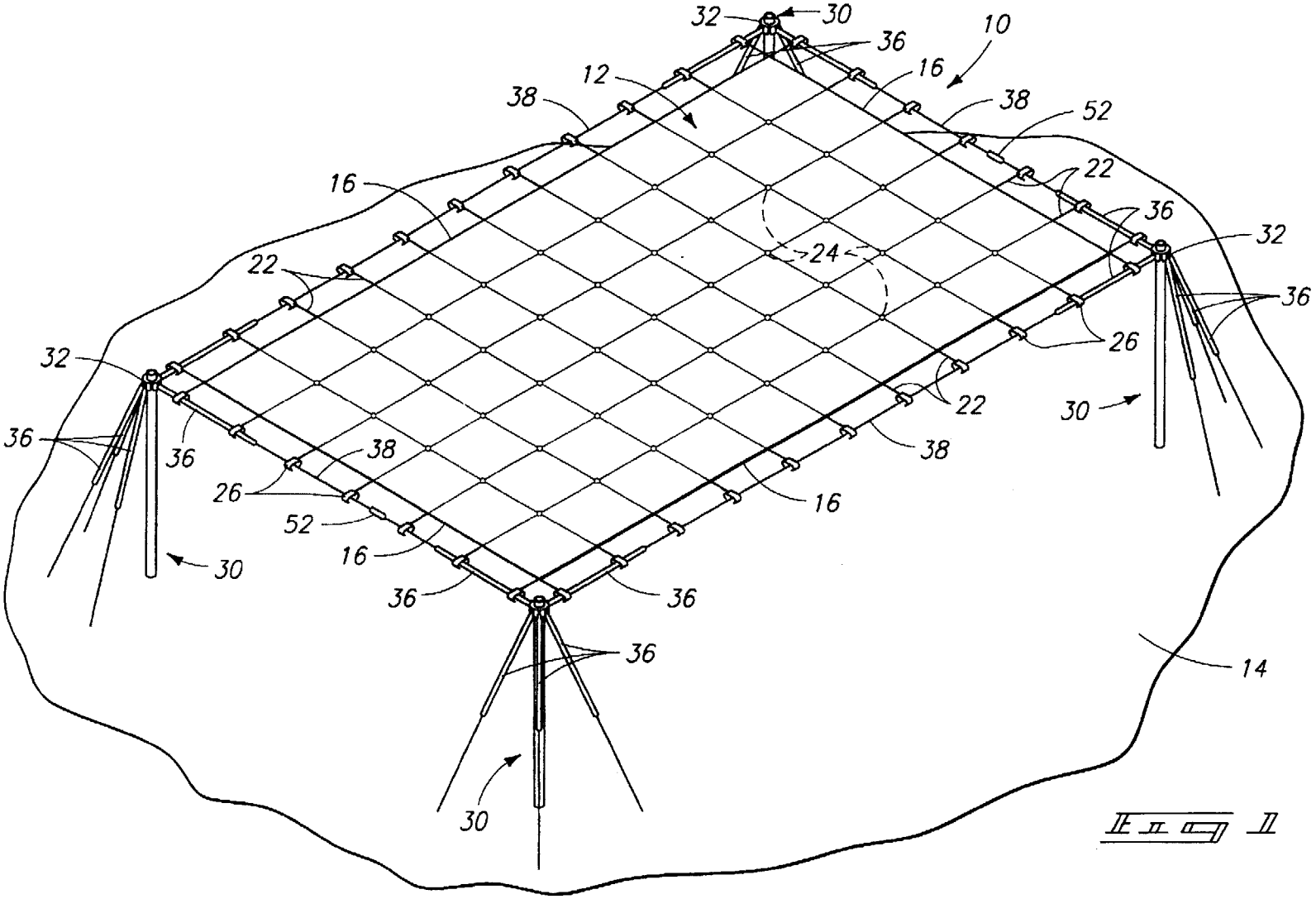
FIG. 1 is a top perspective view of a portable overhead screening structure exemplifying a first preferred form of the present invention.

This disclosure of the invention is submitted in furtherance of the constitutional purposes of the U.S. Patent Laws "to promote the progress of science and useful arts" (Article 1, Section 8).

In a first preferred form, the present invention includes a portable overhead sun screening structure 10 that is exemplified in the drawings by the reference numeral 10. The invention also comprises a canopy member 12 having particular features that will be exemplified in further detail below.

Figure 2:
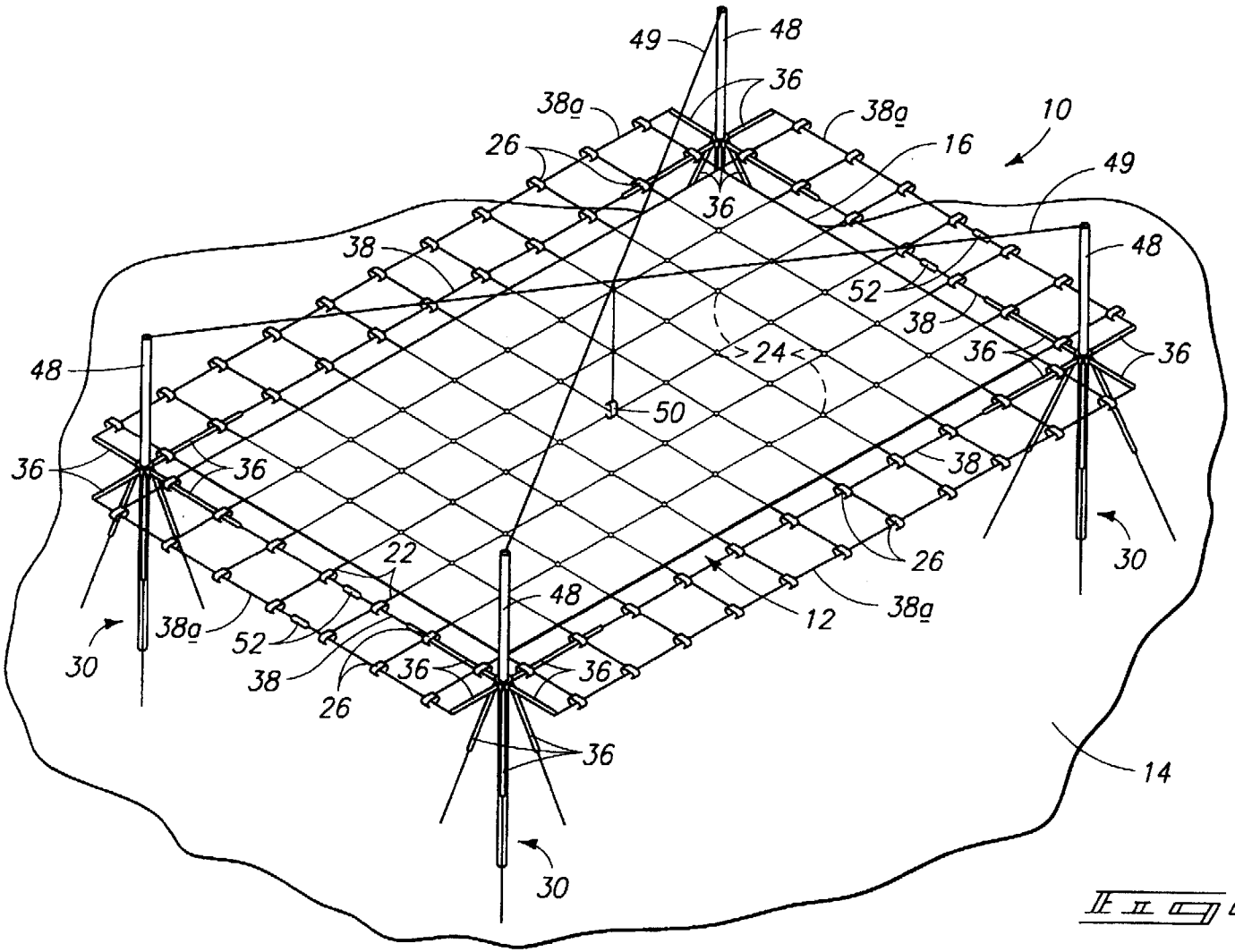
FIG. 2 is a top perspective view of an alternate form.

It is the intent of the present invention to provide portable, lightweight, and durable sun screening capability for various size and shaped surfaces 14 (exemplified in part in FIGS. 1 and 2). The surface 14 may of course vary in form from, say, bare ground, paved areas, beach areas, or other areas where shade is desired. The size and shape of the canopy can also vary, depending upon the use required. It can be made in small sizes and shapes for areas such as backyard or picnic areas, or in much larger sizes to cover areas such as sports playing fields.

Figure 11:
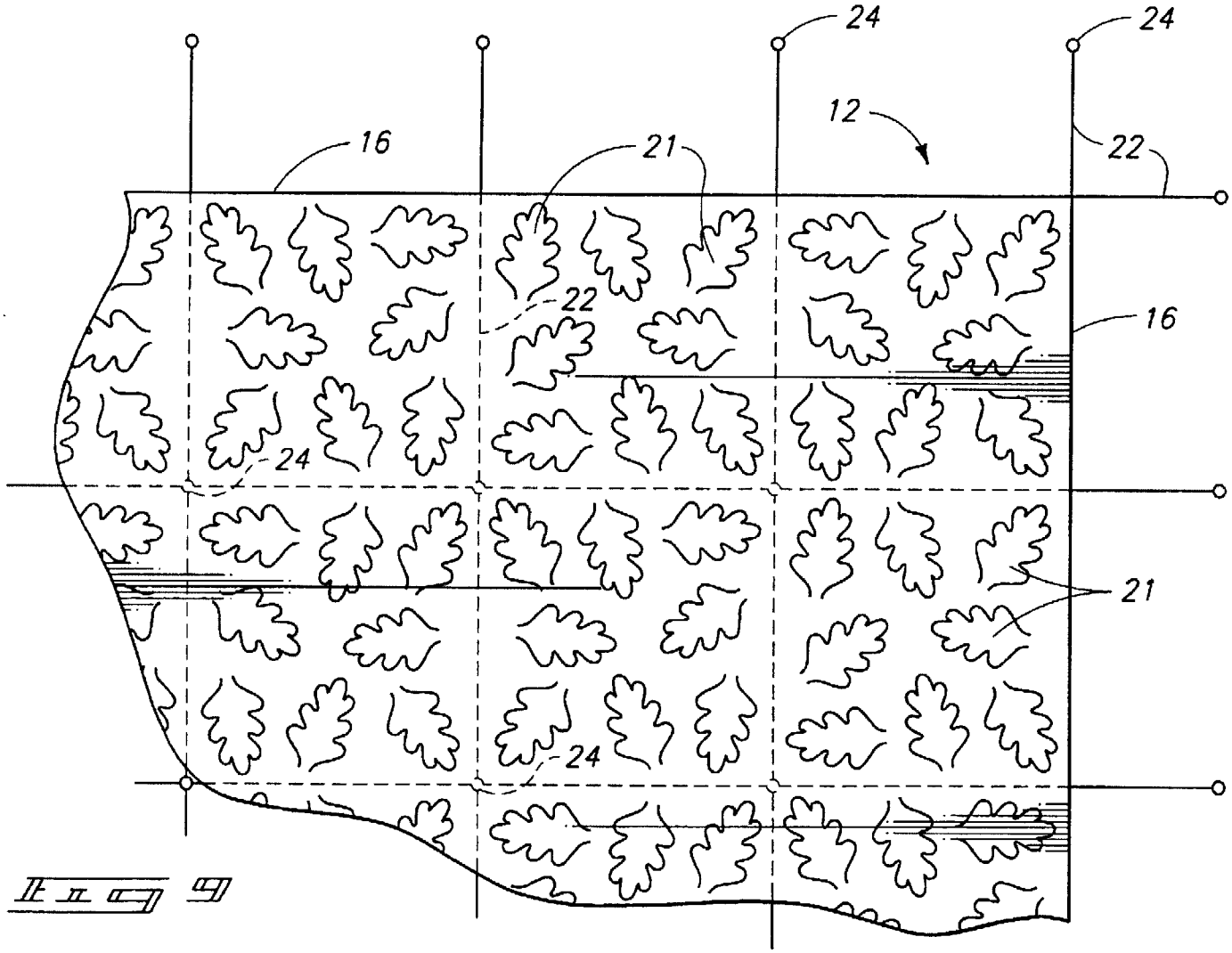
FIG. 11 is a fragmented perspective detail view showing a portion of a preferred canopy with a pattern of scored flaps open to permit passage of air through the canopy.
Figure 11:
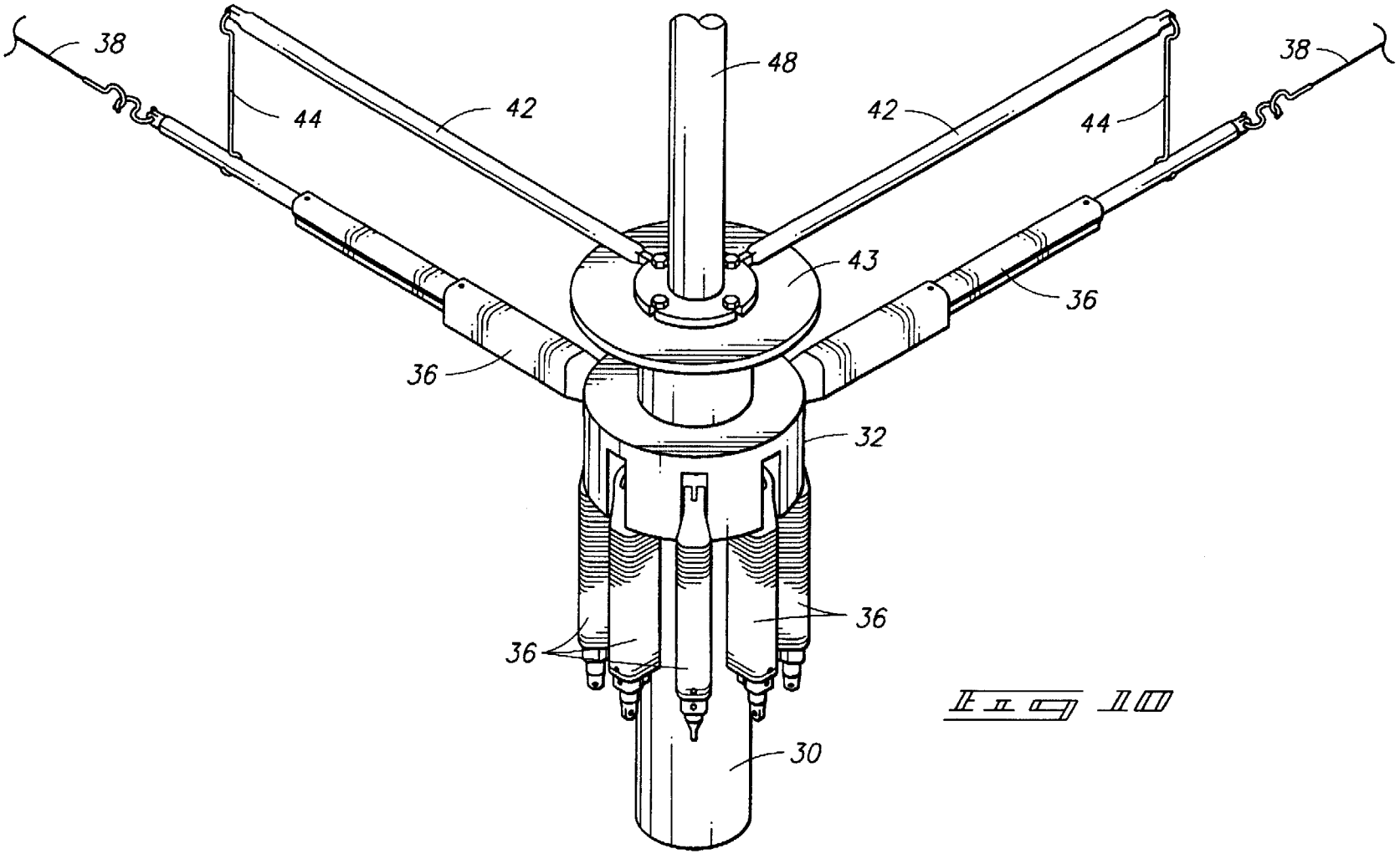
Figure 11:
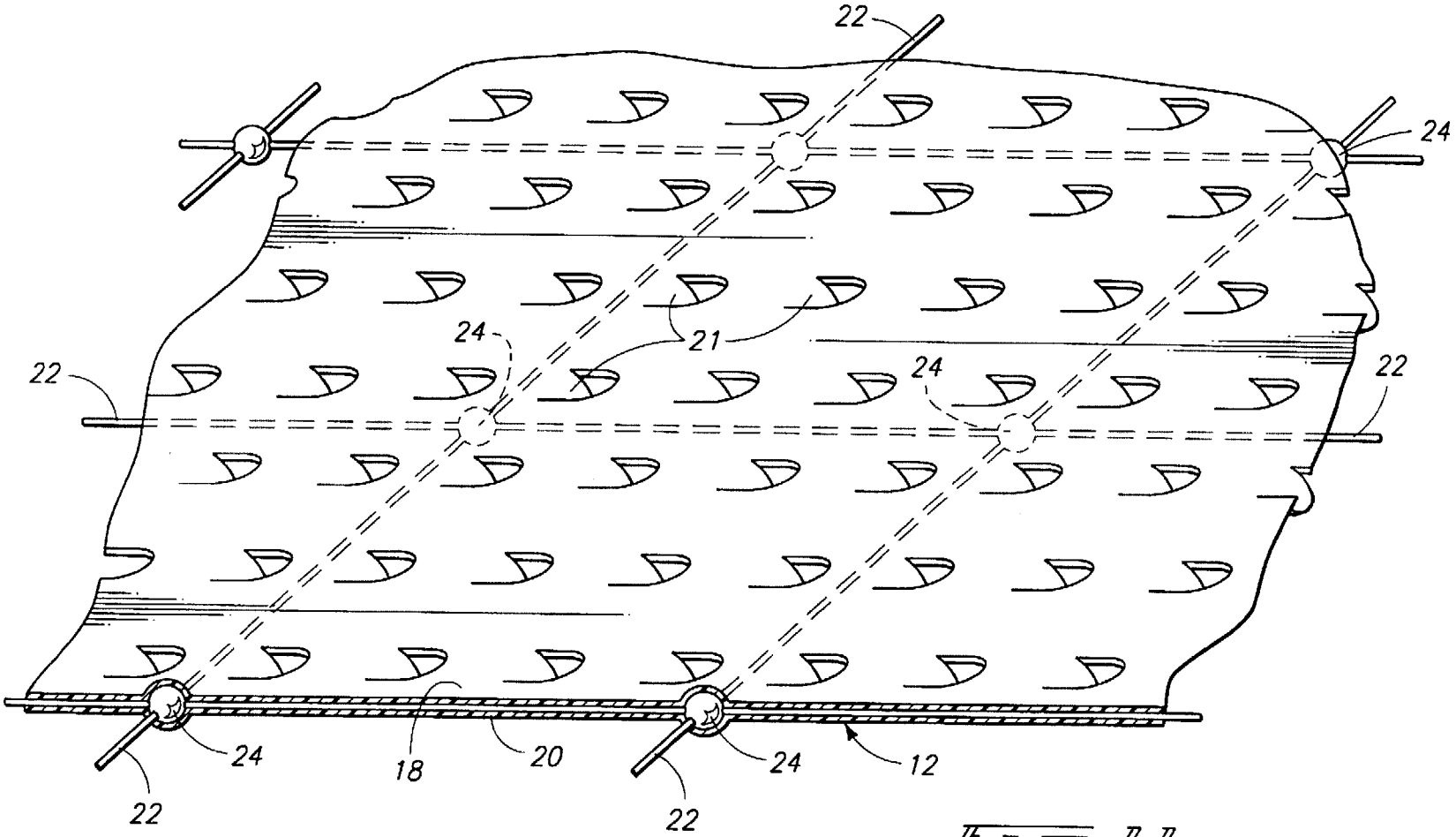
Figure 11:
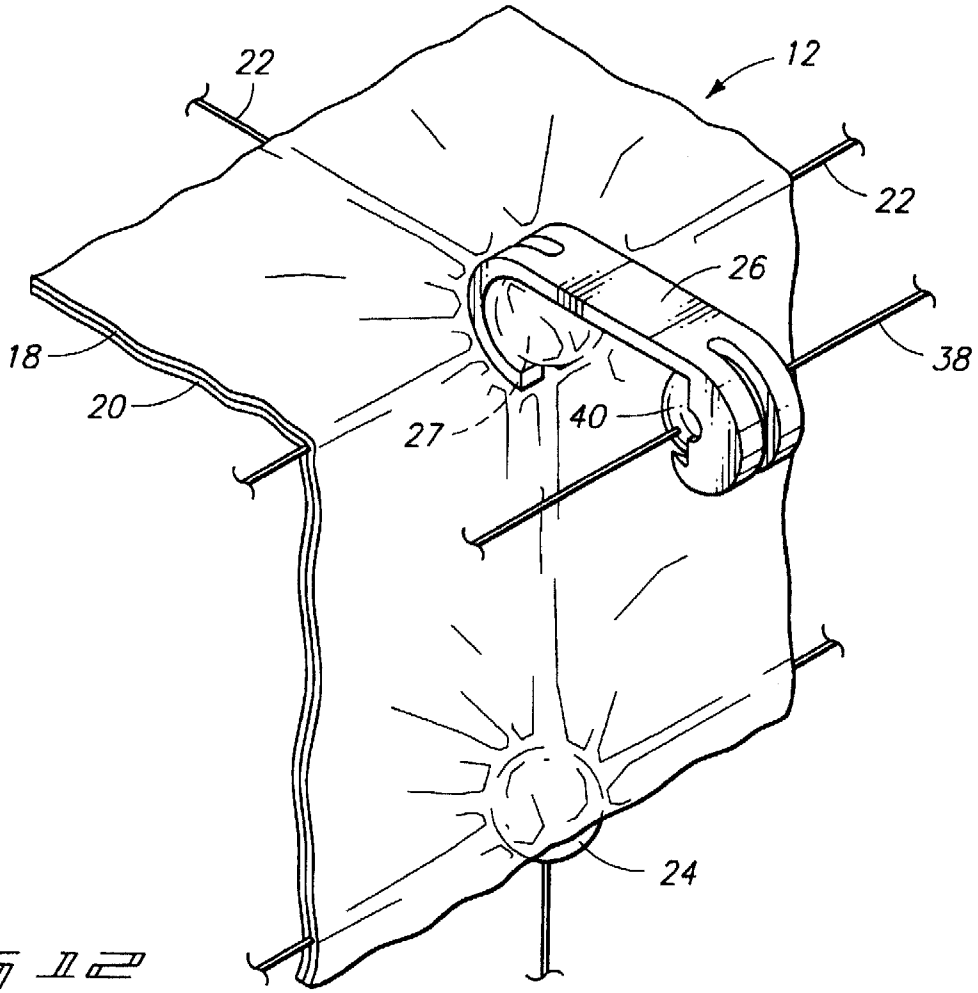

The preferred canopy 12 includes a marginal edge 16 and is comprised of at least one and preferably two overlapping bonded sheets 18, 20 (FIG. 11). As may be gathered above, the edge 16 may take any reasonable form. A rectangular form is shown in FIGS. 1 and 2, but other forms including rectilinear and curvilinear may be used.

At least one of the sheets 18, 20 is preferably formed of a strong, waterproof flexible material such as polyethylene plastic. That the material is preferably waterproof does not mean the canopy is intended to shelter the covered surface against rain. To the contrary, the sheet (or sheets) comprising the preferred canopy is scored at various locations to form flaps 21 that open to permit passage of both air and water through the canopy and to the surface below. The scored flaps 21 will thus prevent a heavy accumulation of water that could otherwise damage the canopy or require additional heavy and expensive reinforcement of the canopy material.

The sheets 18, 20 are preferably bonded together (by appropriate adhesive, sonic welding, fusion, or mechanical fasteners) and span a matrix of reinforcing cords 22, that extend at least to the marginal edge 16 of the canopy. Preferably the cords 22 extend beyond the marginal edge 16 to ends that can be used for attachment to the remainder of the structure to be described more fully below. It is also preferable that the cords 22 intersect, forming a grid pattern to reinforce the canopy in multiple directions. Smaller grid patterns of cords may also be incorporated for strengths to reduce shearing (tearing).

The sheets 18, 20 may vary in thickness, depending upon the strength and span requirements for the canopy. The size and material for the cords 22 may also be selected for the same reasons. Thus a small canopy for covering, say an 8 foot by 12 foot surface, may only require a canopy using a single sheet 18 of 3–4 mil thickness, and the reinforcing cords 22 may be nothing more than ordinary string or twine. A canopy for covering, say, a football field would require a much stronger canopy, so two or more sheets of approximately 4–7 mill thickness could be used, sandwiching reinforcing cords of higher tensile strength.

In a preferred form of the present canopy, beads 24 are affixed to the reinforcing cords 22. In preferred forms, the beads 24 are situated at the intersections of the cords 22 and at the cord ends, outward of the marginal edge 16. The beads 24 are used to reinforce the cord intersections and to provide purchase for connecting members 26 that are used to secure the canopy to the remainder of the structure. It is not necessary that the beads be situated at every intersection, but is preferable that they at least be situated at locations adjacent the marginal edge 16.

The beads 24 may be formed of appropriate plastic and be secured by known processes to the cords (using an appropriate adhesive, or mechanical processes such as swaging). Once fastened in place, the cords and beads are next laminated or otherwise secured in position between sheets 18, 20.

In operation, the canopy may be folded for storage, or rolled due to its flexible nature. Then, before use, the canopy is unfolded as desired, and attached to a support structure. The reinforcing cords, and beads serve to secure the canopy against lifting forces and against elemental forces such as wind, that could otherwise produce stress and tear the sheets. The scored flaps 21 will function at this time to permit passage of air through the canopy that could otherwise generate damaging forces. The flaps 21 will also permit passage of rainwater, and the waterproof nature of the sheets will prevent undesired absorption and attendant increase in canopy weight. Dappled light will also be permitted through the scored flaps 21 which, as indicated above may be leaf shaped to lend a natural appearance to the otherwise shaded surface.

To provide elevated support for the present canopy 12, a plurality of elongated poles 30 are provided in spaced apart relation and set upright along the surface. The poles may be of selected length and girth, according to the nature of the use and expanse of the canopy 12. Further, the poles 30 may be solid or supplied in interfitting or telescoping lengths.

Collars 32 are slidably mounted for elevational (longitudinal) movement on the poles 30. The collars will thus slide from positions adjacent the surface 14 at the pole bottom ends, to locations adjacent the pole top ends.

Figure 12:
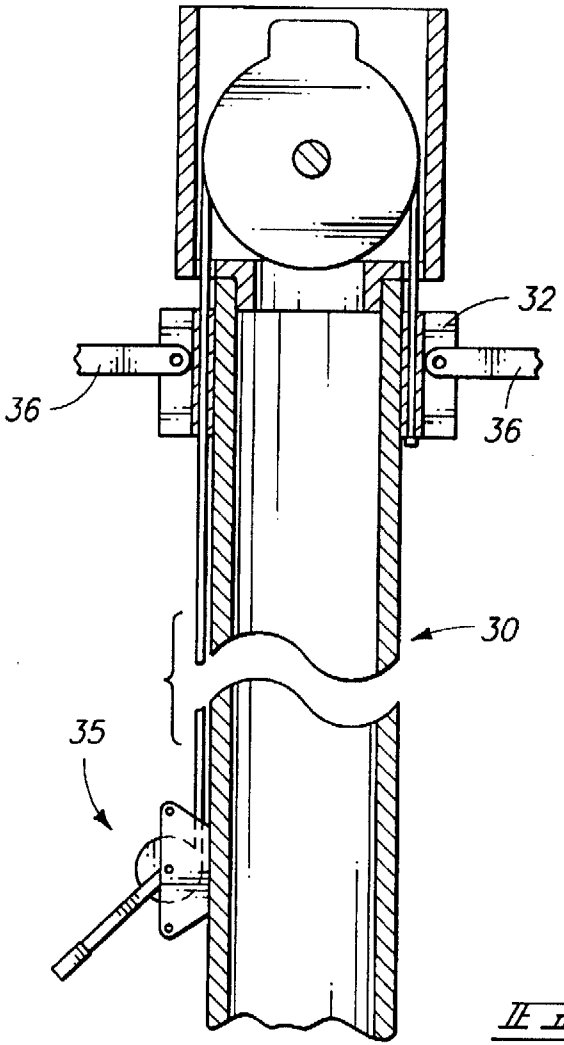
FIG. 12 is a fragmented sectional view illustrating a lift mechanism for selectively moving a collar to an elevated position on the associated pole.

Appropriate lift mechanisms 35 (FIG. 12) are provided to enable selective lifting and lowering of the collars 32 at selected operational elevations on the respective poles. The lift mechanisms 35 may be provided in the form of ratcheting winches, connected to the associated collars by cords extending over pulleys at the top ends of the poles as shown in FIG. 12. The ratchet lift mechanisms will allow the user to move the collars upwardly, or downwardly to any position along the poles.

The above arrangement enables installers to initially connect the canopy to the collars along the ground or other surface, then raise the canopy and connections overhead for operation. Then when it is desired to disassemble the structure, the lift mechanism 35 can be used to facilitate lowering of the canopy in a quick and effective manner.

At least two elongated stay members 36 are mounted to each collar 32. Each stay member 36 is pivotable on the associated collar between an inoperative position substantially parallel to the associated pole 30, and an operative position substantially perpendicular to the pole. The two positions are illustrated in FIG. 10 where (5) stays are shown in inoperative positions, and two stay members are shown in extended, operative positions.

It is noted that the stay members 36 on each pole 30 are angularly offset from one another about the associated pole. The angular relationship may vary but the included angle between adjacent stays is preferably between 45° and 90° with the pole 30 at the vertex.

Figure 5:
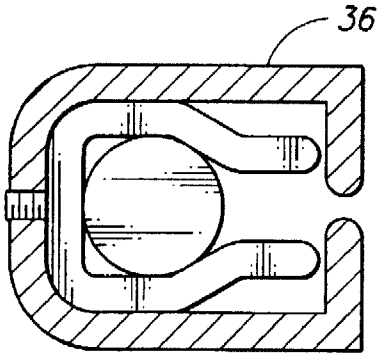
FIG. 5 is an enlarged sectional view through the stay member shown in FIG. 4, taken along line 5—5 therein.

As shown in FIGS. 4–7, the individual stay members are comprised of interfitting sections, such that the stay members are extendible. The interfitting sections are formed and arranged as shown in FIG. 5 to interlock such that the stays will not rotate on their own longitudinal axes, but will only extend or retract. The shape of the sections is also provided as such to lend longitudinal stability to the stays, to avoid bending when the stays are attached to the canopy and stressed to pull the canopy taut.

Figure 3:
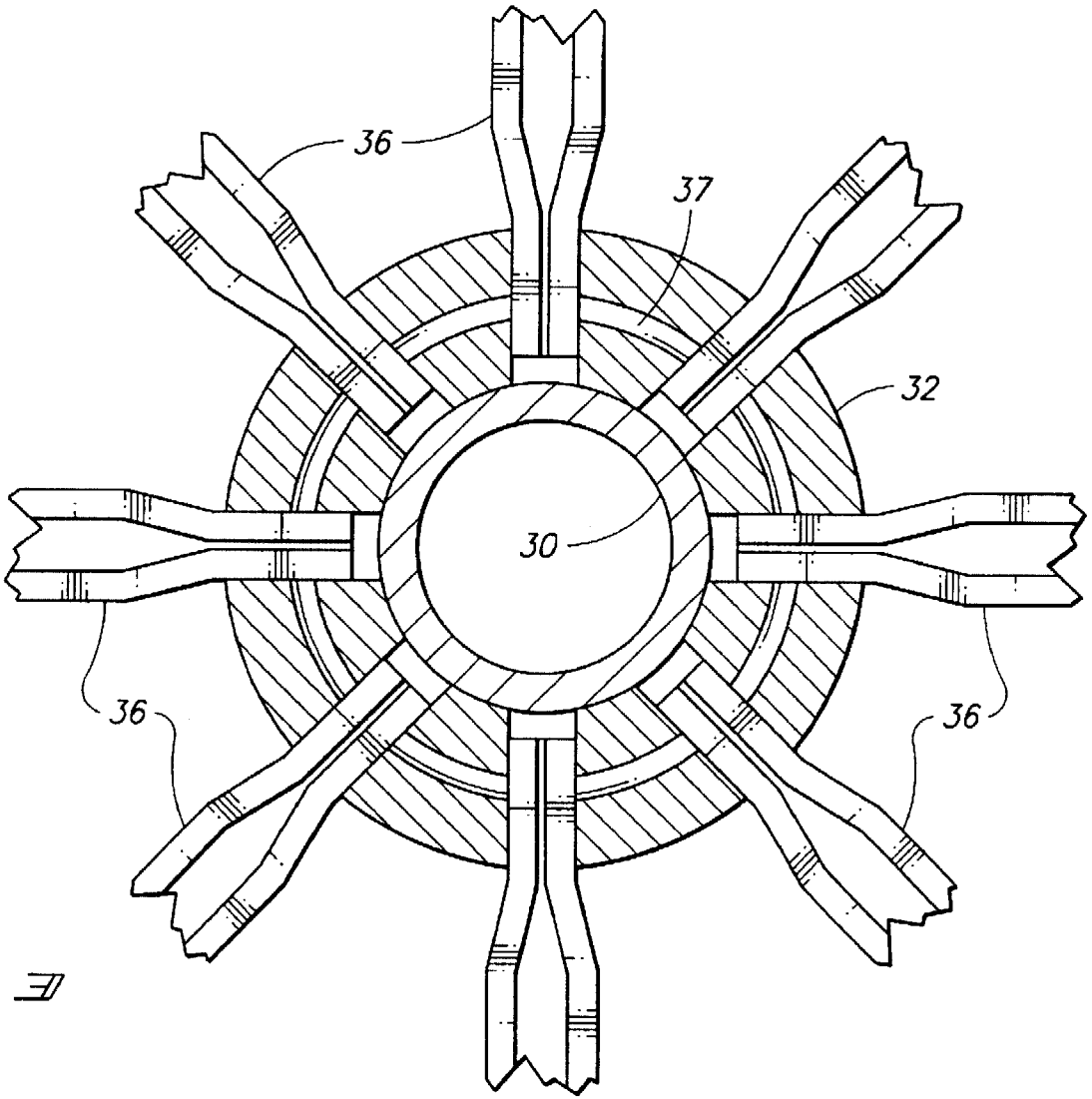
FIG. 3 is an enlarged sectional view taken transversely through a pole and collar, and showing fragmented stay members mounted on the collar.
Figure 4:
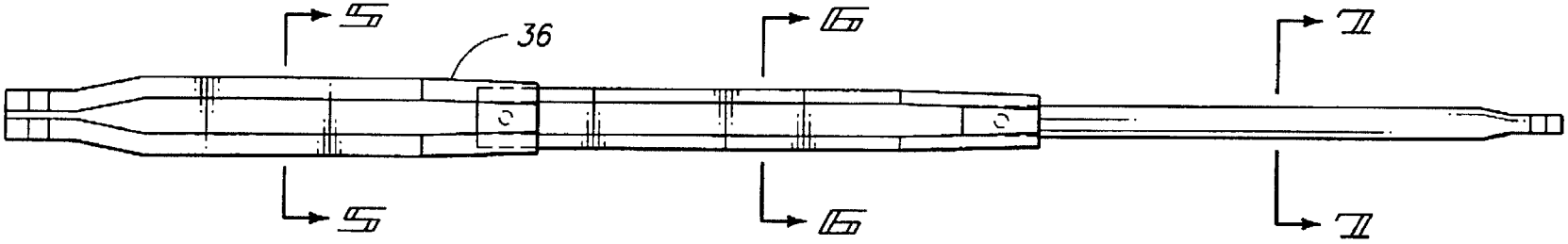
FIG. 4 is a plan view of a single stay member in an extended condition.
Figure 7:
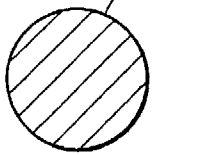
FIG. 7 is an enlarged sectional view through the stay member shown in FIG. 4, taken along line 7—7 therein.
Figure 6:
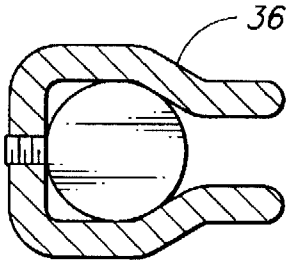
FIG. 6 is an enlarged sectional view through the stay member shown in FIG. 4, taken along line 6—6 therein.

FIG. 3 shows a section view taken transversely through a typical pole, an associated collar 32, and shows 8 stays mounted to the collar. All 8 stays 36 are shown in their upwardly pivoted, operative positions. The collar is slotted to accept flattened ends of the stays 36, and a ring 37 on the collar extends through the flattened stay ends to pivotably mount the stays 36.

As may be noted in FIG. 1, the stays may be used to secure and support the canopy, and to otherwise function if desired as braces for the poles. FIG. 1, for example shows three of the stays on each collar functioning as pole braces, while two stays are used for canopy support. FIG. 2 makes use of four stays as braces and four stays for holding the canopy taut. Alternatively, all stays may be used for canopy support, depending upon the number of stays used, and the nature of the canopy to be supported. As another alternative some of the stays may simply hang loosely from the collars 32 as shown in FIG. 10. In each instance, however, at least some of the stays will be used for canopy support in the manner to be described below.

Flexible guy cords 38 having opposed ends are provided for releasable attachment to the stay members. The cords 38 are of sufficient length to extend between two selected stay members on successive poles with the two selected stay members in their operative positions. Four such guy cords 38 are shown in FIGS. 1 and 2, extending about the perimeter of the canopy 12.

The connector members 26 extend from the flexible guy cords 38 to connect with selected beads 24 on the canopy or on the reinforcing cords 22, to hold the canopy taut over the surface. One such member 26 is shown in detail in FIG. 8. As shown, the guy cords 38 may also include beads 40 at spaced locations along their lengths, corresponding to spacing of the beads 24 along the canopy 12 and on the reinforcing cords 22. The guy cord may also be designed with closer spaced beads. Such guy cords would be used if poles were not readily available. In such cases, the guy cords might be strung from trees to conform to the desired canopy or shade pattern. The connector is designed in such a manner to function as on eyelet and not allow itself to move backward or forward along the guy cord, i.e., the fingers on the connector must secure the beads in place so that it will not shift.

The connector members 26 may extend between successive beads 40 on the guy cords to the canopy, to hold the canopy at the approximate level of the guy cords. The connector members 26 may also be connected between the canopy and the extended, operative stay members as shown in FIGS. 1 and 2.

Figure 8:
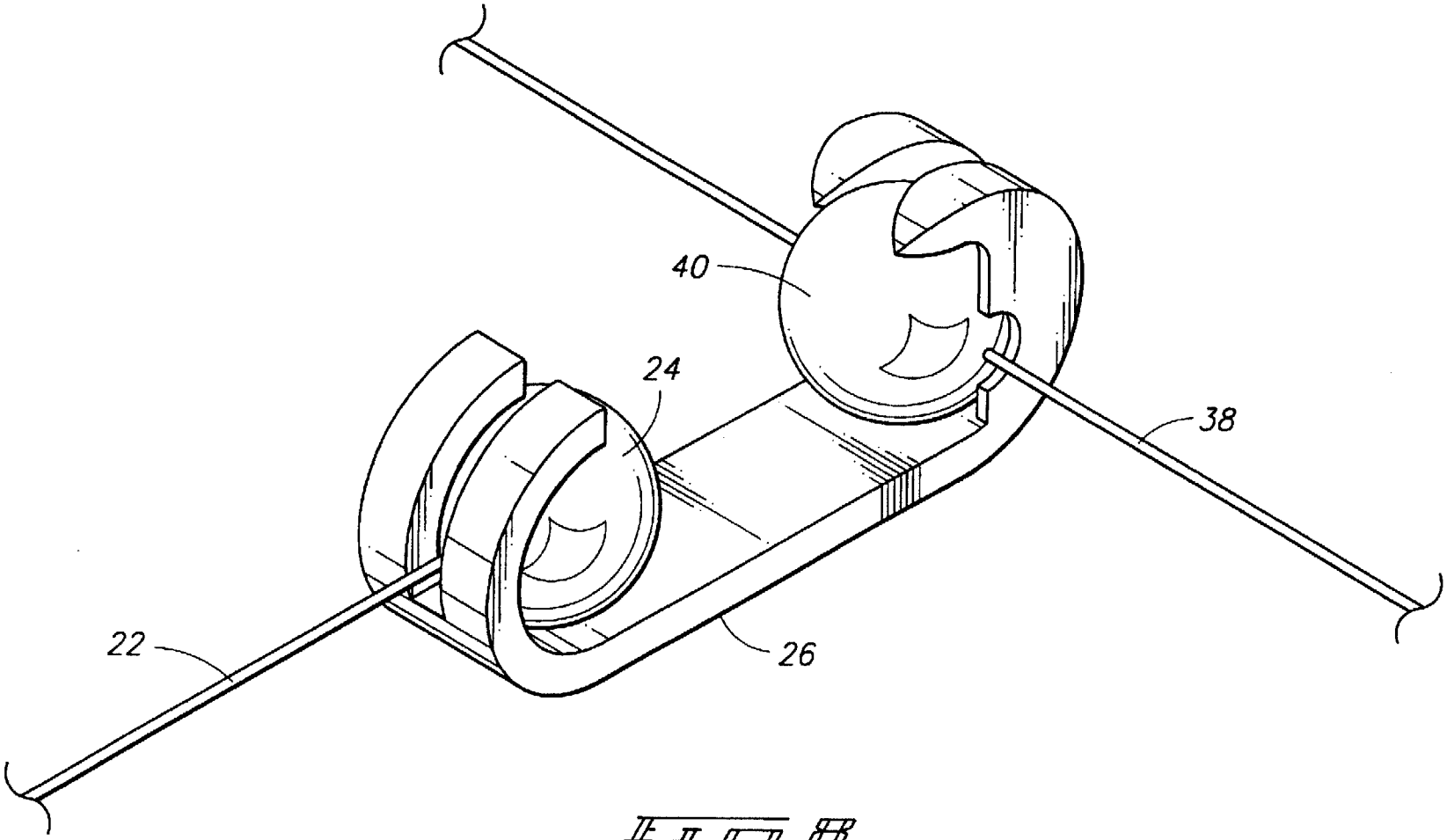
FIG. 8 is an enlarged perspective detail view of a connector and an associated guy and reinforcing cord.

FIG. 8 shows a single connector member as a bar with inwardly hooked ends. The hooked ends are bifurcated, leaving open gaps for releasably receiving, if necessary, short sections of the guy cord or reinforcing cords. This configuration for the connector members also lends the ability for the connectors to grasp and hold the canopy itself by grasping beads 24 within the canopy body as shown in the fragmentary presentation of FIG. 13.

In alternate preferred forms of the present structure, brace arm members 42 are provided on the collars 32 and are configured to engage and brace the stay members 36 in the operative positions thereof. An example of such brace arm members 42 is clearly shown in FIG. 10 where an auxiliary collar 43 is shown mounting the braces arm members 42, one for each operative stay member 36, above the collar 32. The brace arm members 42 are rigid, non extensible rods extending radially from the collars 43 and are arranged in substantial parallel relation to the stays 36 (when the stays are in their extended operative positions). Hangers 44 are provided at ends of the braces 42 to releasable engage outward portions of the stays 36, to support the engaged stays in their operative positions. The collars 43 are preferably oriented above collars 32 and rest on the top ends of the poles 30.

It is noted that in smaller variations of the present structure, the braces 42 and auxiliary collars 43 may be substituted for the collars 32 and stays 36. In such situations, the brace arm members 42 and collars 43 will effectively become the equivalents of the collars 32 and stays 36. Due to the strength inherent in this configuration, a solid canopy (without scored flaps 21) to seal against rain may be used.

As shown in FIG. 2, pole extensions 48 may optionally be releasable mounted to the poles 30. The extensions 48 will extend upwardly from the poles 30 to provide elevated anchorage for diagonal guy cords 49 extending from the pole extensions diagonally over the canopy. The crossed cords 49 are connected to the canopy at a central point 50 thereon. The extensions may simply slip into open ends of the poles 30 above the collars 32 or 43 depending on the configuration to be used. The diagonal cords 49, extending from the extensions 48 may be used to provide support to the central area of the canopy, especially when used to span a large area. In this manner, additional pole support of the area spanned by the canopy 12 is eliminated and the surface below remains clear for any intended activity to be performed.

Operation of the preferred forms of the present structure will be described starting with an exemplary set-up sequence. As a first step with appropriate poles in place, the canopy is spread over the surface to be shaded. Next the collars 32 (and 43, if used) are positioned at either the top or bottom of the pole. The poles 30 are positioned about the perimeter of the canopy, adjacent the canopy corners. Depending upon the expanse of the canopy, additional poles may be provided outwardly adjacent the canopy perimeter, between the corner poles.

Next, appropriate ones of the stays 36 are positioned into parallel alignment with the adjacent canopy side edges. As shown in FIGS. 1 and 2, two stays on each corner pole are arranged in this manner. Now the guy cords 38 are attached between opposed stay members 36, outward of the canopy perimeter and substantially parallel to the marginal canopy edges. At this time, ends of the remaining, unused stay members may be fitted with guy cords and anchored to the surface to provide added stability after the canopy is raised on the upright poles 30.

Connectors 26 may next be attached between the guy cords 38 and selected beads 24 on the canopy 12 or reinforcing cords 22. Additional connectors may also be used between the areas of the canopy adjacent the corners and the operational stays 36. The connectors 26 are each attached with one hooked end engaging bead 24 and the opposed end engaging an associated bead 40 along an adjacent guy cord 38. Close spacing of the connectors will assure that the shape of the canopy will be substantially maintained after elevation.

If a large canopy is to be raised, additional guy cords **38*a* (FIG. 2) may be used to advantage, between selected additional stays 36. The cords 38*a* should extend substantially parallel to the previously positioned guy cords 38. Additional connector members 26 may be used, along with short sections of extra cord to interconnect the additional cords 38*a* to the cords 38** and canopy.

At this point, it may be desirable to pull the canopy taut, at least in one direction across its expanse. In the rectangular example shown, it may be desirable to tension the canopy across its width dimension. This may be done by placing tension along the guy cords 38 (and **38*a* if used) that span the short sides of the canopy. Tensioning may be accomplished by use of appropriate turnbuckles 52 or other apparatus that will effectively shorten the short-side guy cords 38 (and cords 38*a*** if used). In response, the collars at the corner poles will tend to pivot about their associated poles and swing the stays and guy cords (connected to the long sides of the canopy) in opposite outward directions, away from the canopy. The canopy, being connected to the stays and guy cords, is therefore placed under tension across its width dimension.

If desired, pole extensions 48 may be added to the poles 30, and diagonal guy cords 49 extended across the canopy from above. The intersecting diagonal cords 49 are then connected at 50 (or at other selected locations) to the canopy, in order to provide added central support to the canopy. This configuration may also be used if a canopy is used to prevent the passage of air or water.

The above steps may be performed while the canopy is resting on the support surface. The canopy may be elevated, once the above assembly steps are complete, simply by use of the ratcheting lift mechanisms to lift the collars 32 upwardly along the poles 30.

The elevated canopy 12 will provide ample shade to the surface below, while the scored flaps 21 function to allow a limited amount of sunlight and air passage, thereby reducing the problem that could otherwise occur due to wind damage. The canopy that will span the underlying surface area without requiring support from within the area covered by the canopy.

Lowering of the canopy is a simple matter of disconnecting the stays used as braces. The canopy will not drop as dead weight, but will descend slower due to air resistance offered by the canopy expanse. Disassembly may then take place simply by substantially reversing the steps described above.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A portable overhead sun screening structure for shading a surface, comprising:

a canopy member having a marginal edge and comprised of at least one sheet spanning a matrix of reinforcing cords, the reinforcing cords extending to the marginal edge;

beads affixed to the reinforcing cords adjacent the marginal edge;

a plurality of elongated poles spaced apart and set upright along the surface;

collars slidably mounted to the poles for elevational movement thereon;

at least two elongated stay members mounted to each collar;

wherein each stay member is pivotable between an inoperative position substantially parallel to the associated pole, and an operative position substantially perpendicular to the pole;

wherein the stay members on each pole are angularly offset from one another about the associated pole;

flexible guy cords having opposed ends releasably attached to the stay members of sufficient length to extend between two selected stay members on successive poles with the two selected stay members in their operative positions; and connector members extending from the flexible guy cords to connect with selected beads on the sheet, to hold the sheet taut over the surface.

2. A portable overhead sun screening structure for shading a surface as claimed by claim 1, wherein the sheet comprising the canopy is scored to form flaps that open to permit passage of air through the canopy.

3. A portable overhead sun screening structure for shading a surface as claimed by claim 1, further comprising lift mechanisms on the poles, connected to the collars and selectively operable to raise and lower the collars on the poles.

4. A portable overhead sun screening structure for shading a surface as claimed by claim 1, wherein the sheet comprising the canopy is scored to form flaps that open to permit passage of air through the canopy; and wherein the flaps are leaf shaped.

5. A portable overhead sun screening structure for shading a surface as claimed by claim 1, wherein the reinforcing cords intersect and wherein the beads join the reinforcing cords at the reinforcing cord intersections.

6. A portable overhead sun screening structure for shading a surface as claimed by claim 1, wherein the sheet is plastic and is bonded to the reinforcing cords and at least some of the beads.

7. A portable overhead sun screening structure for shading a surface as claimed by claim 1, wherein there are at least two sheets comprising the canopy and wherein the two sheets are bonded together, sandwiching the reinforcing cords and at least some of the beads.

8. A portable overhead sun screening structure for shading a surface as claimed by claim 1, wherein the stay members are extendible.

9. A portable overhead sun screening structure for shading a surface as claimed by claim 1, wherein there are at least four stay members spaced substantially equiangularly about each pole and pivotably mounted to associated collars.

10. A portable overhead sun screening structure for shading a surface as claimed by claim 1 wherein the guy cords include beads secured in spaced relation along the length thereof, and configured to be releasably secured to the connector members.

11. A portable overhead sun screening structure for shading a surface as claimed by claim 1, further comprising braces on the poles configured to engage and brace the stay members in the operative positions thereof.

12. A portable overhead sun screening structure for shading a surface as claimed by claim 1, further comprising pole extensions releasable mounted to the poles and extending upwardly therefrom, and diagonal guy cords extending from the pole extensions diagonally over the canopy and connected to the canopy at a central point thereon.

13. A portable overhead sun screening structure for shading a surface as claimed by claim 1, further comprising braces on the poles positioned above the stay members and including brace arms and hangers extending outwardly from the poles to engage and support the stay members in the operative positions thereof.

14. A portable overhead sun screening canopy, comprising:

a sheet of flexible material extending to marginal edges and having an upper surface and a bottom surface;

a matrix of reinforcing cords secured to the bottom surface of the sheet;

wherein the reinforcing cords extend span the sheet and extend at least to the marginal edges;

beads affixed to the reinforcing cords adjacent the marginal edge; and wherein the sheet is scored to form flaps that open to permit passage of air through the canopy.

15. A portable overhead sun screening canopy as claimed by claim 13, wherein the flaps are leaf shaped.

16. A portable overhead sun screening canopy as claimed by claim 13, wherein the reinforcing cords intersect one another and wherein the beads are situated at the reinforcing cord intersections.

17. A portable overhead sun screening structure for shading a surface, comprising:

a canopy member having a marginal edge and comprised of at least two sheets bonded together, sandwiching a matrix of reinforcing cords that span the sheets and extend beyond the marginal edge;

a plurality of elongated poles spaced apart and set upright along the surface;

collars mounted to the poles;

at least two elongated stay members mounted to each collar;

wherein each stay member is pivotable between an inoperative position substantially parallel to the associated pole, and an operative position substantially perpendicular to the pole;

flexible guy cords having opposed ends releasable attached to the stay members of sufficient length to extend between two selected stay members on successive poles with the two selected stay members in their operative positions;

wherein the stay members on each pole are angularly offset from one another about the associated pole; and connector members attached to the flexible guy cords and connected to the reinforcing cords to hold the sheet taut over the surface.

18. A portable overhead sun screening structure for shading a surface as claimed by claim 16 wherein the stay members are comprised of telescoping sections.

19. In a portable overhead sun screening structure for shading a surface, comprising:

a canopy member having a marginal edge and comprised of at least one sheet spanning a matrix of reinforcing cords, the reinforcing cords extending to the marginal edge;

beads affixed to the reinforcing cords adjacent the marginal edge;

flexible guy cords having beads affixed along the length thereof; and connector members extending from selected beads on the flexible guy cords to connect with selected beads on the sheet.

* * * * *